US007426767B2

(12) United States Patent
Mossbeck

(10) Patent No.: US 7,426,767 B2
(45) Date of Patent: Sep. 23, 2008

(54) WAFFLE-CUT FOAM MATTRESS OR CUSHION PAD

(75) Inventor: Niels S. Mossbeck, Carthage, MO (US)

(73) Assignee: Sleep Innovations, Inc., West Long Branch, NJ (US)

( * ) Notice: Subject to any disclaimer, the term of this patent is extended or adjusted under 35 U.S.C. 154(b) by 0 days.

(21) Appl. No.: 11/530,979

(22) Filed: Sep. 12, 2006

(65) Prior Publication Data

US 2008/0060139 A1 Mar. 13, 2008

(51) Int. Cl.
*A47C 27/14* (2006.01)

(52) U.S. Cl. ..... 5/736; 5/724; 5/652.1

(58) Field of Classification Search ..... 5/652.1, 5/736, 740, 724, 731, 655.9
See application file for complete search history.

(56) References Cited

U.S. PATENT DOCUMENTS 3,197,357 A 7/1965 Schulpen
3,222,697 A * 12/1965 Scheermesser ..... 428/160
3,940,811 A * 3/1976 Tomikawa et al. ..... 5/740
4,207,636 A 6/1980 Ceriani
4,700,447 A * 10/1987 Spann ..... 29/418
4,713,854 A * 12/1987 Graebe ..... 5/652
4,866,800 A * 9/1989 Bedford ..... 5/652.1
5,249,319 A * 10/1993 Higgs ..... 5/714
6,668,409 B1 * 12/2003 Blumer ..... 5/740

* cited by examiner

*Primary Examiner*—Patricia Engle
*Assistant Examiner*—William Kelleher
(74) *Attorney, Agent, or Firm*—Sterne, Kessler, Goldstein & Fox, P.L.L.C.

(57) ABSTRACT

A resilient foam or fiber cushion or mattress pad having wave-shaped top and bottom surfaces with the two surfaces angled relative to one another and the valleys of the wave-shaped patterns intersecting to create ventilation holes or apertures through the pad. The pad may be utilized either as a topper pad for a cushion or mattress or as a spring core element of a cushion or mattress.

17 Claims, 3 Drawing Sheets

WAFFLE-CUT FOAM MATTRESS OR CUSHION PAD

FIELD OF THE INVENTION

The present invention relates to a foam mattress or cushion pad and method of manufacturing the same for use either as a topper for a mattress or cushion or as a resilient core of a mattress or cushion.

BACKGROUND OF THE INVENTION

It is quite common in the manufacture of mattresses or cushions today to build up the mattress or cushion from layers of foam material having differing resilience and support, as well as breatheability, i.e., ability to allow air to pass through the layer or layers of foam material. Most commonly, the foam materials used in such mattresses or cushions are polyurethane-based or latex\synthetic latex based. Those materials, though, are generally closed-cell materials which may create air pockets to trap the air and thereby insulate or trap body heat in the mattress or cushion, thereby rendering the mattress or cushion uncomfortable and possibly unhealthy. To counter this entrapment of heat in the mattress or cushion, open-cell foams or fibers, such as polyester foams or fibers, are often used and are often surface modified by being cut in different configurations, such as convoluted surfaces having an egg crate or rib configuration or, alternatively, the layers of foam are often perforated to create better air flow characteristics for dissipating body heat. Such convoluted or perforated foam may be better for air circulation than flat sheets of foam material, but such configurations may give rise to less support or less resiliency of the resulting layers of foam material or give rise to a waste of material if the foam is perforated to create flow passages. The present invention is directed to overcoming the air flow circulation problem characteristics and the support problems of most convoluted foam materials, as well as air circulation problems characteristic of those configured convoluted foam layers while simultaneously avoiding the waste foam characteristics and cost of perforating the layers of foam to improve air flow characteristics.

SUMMARY OF THE INVENTION

In accordance with the practice of this invention, a foam or fiber pad is cut on both top and bottom sides in a wave-shaped pattern of ridges and valleys. The ridges and valleys on the bottom side of the pad are angled relative to the ridges and valleys on the top side of the pad and the depth of the valleys on the top and bottom are sufficient that the valleys intersect one another to create spaced air ventilation holes through the foam or fiber pad. In order to create such foam or fiber pads, a block of foam or fiber material is cut horizontally from one side or corner of the block of foam in a wave-shaped and preferably, sinusoidal-shaped pattern from one side or corner to the opposite and then the block of foam or fiber is rotated 90° and a similar horizontal wave-shaped cut is made from one side of the block to the opposite side. Because the block is rotated 90° from the first cut to the second, the wave-shaped pattern of the second cut is normal or perpendicular to the wave-shaped pattern of the first cut. By making repeated cuts through the block in this fashion with a conventional band saw cutter, and by spacing the cuts such that adjacent cuts intersect, the block may be cut into multiple pads having a wave-shaped top surface, a wave-shaped bottom surface with the waves of the top and bottom surface offset from one another by 90° and with the valleys of the top surface intersecting the valleys of the bottom surface to create the spaced holes or ventilation apertures through the multiple pads so created.

In accordance with the practice of this invention, the ventilated pads configured as described hereinabove may be used either as topper pads on a mattress or cushion or as resilient spring cores of a mattress or cushion, which cores may be surrounded by solid foam encasement side rails and covered top and bottom by flat or perforated sheets of foam to create a mattress body ready to be upholstered either with or without fiber padding between the top surface of the mattress and the upholstered covering.

These and other objects and advantages of this invention may be more apparent from the following description of the drawings.

BRIEF DESCRIPTION OF THE DRAWINGS

With reference to FIG. 1, there is illustrated a resilient foam pad 10 incorporating the invention of this application. This pad may be made from polyurethane foam, latex foam or a synthetic latex/latex foam material or it may be made from a compacted plastic fiber material. It comprises a sinusoidal wave-shaped pattern of laterally extending ribs or ridges 12 and valleys 14 on the top surface and a wave-shaped pattern of longitudinally extending ribs or ridges 12*a* and valleys 14*a* on the bottom surface. It will be noted that the valleys of the bottom surface 18 intersect the valleys of the top surface 16 so as to create spaced holes or apertures 20 through the pad. Consequently, when used as a top surface pad (often called a topper pad), or as a core spring element of a cushion or mattress, air is able to breathe through these apertures and thereby avoid entrapment of body heat within the pad.

Figure 1:
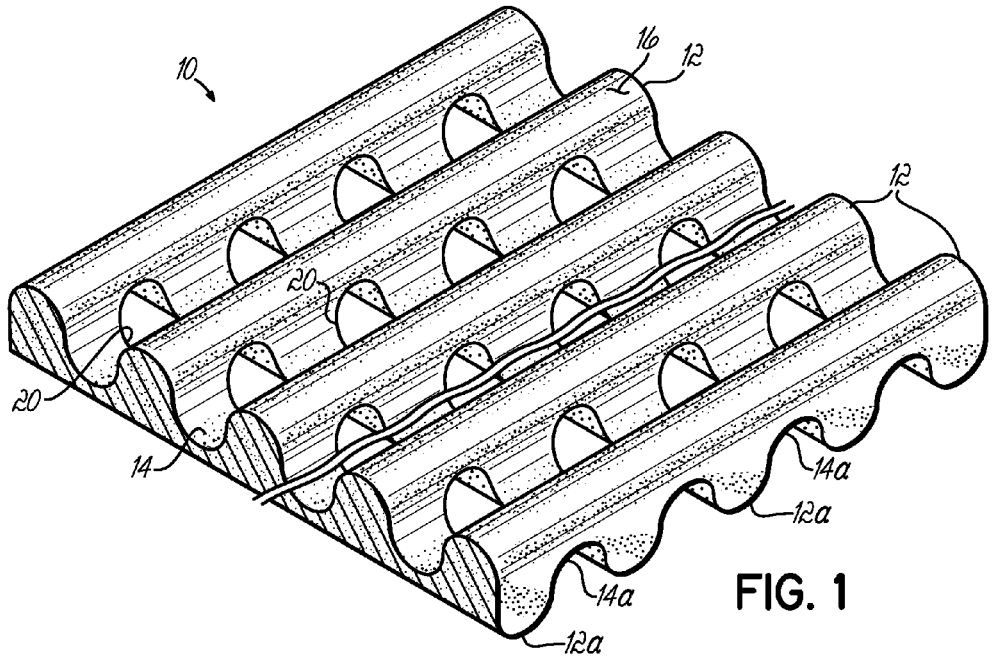
FIG. 1 is a perspective view of a foam pad incorporating the invention of this application.
Figure 2:
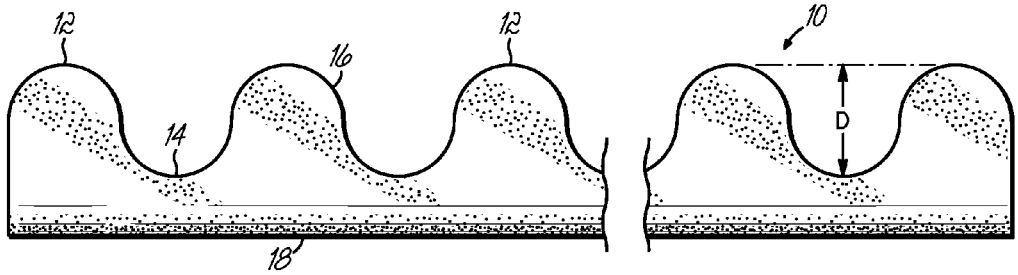
FIG. 2 is a side elevational view of the pad of FIG. 1.
Figure 3:
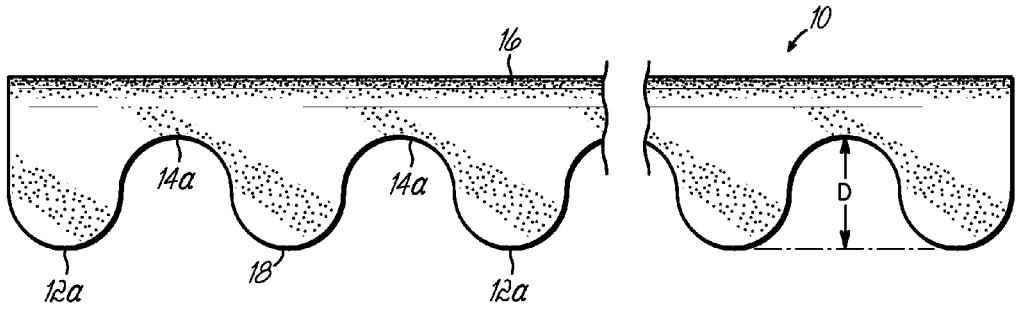
FIG. 3 is an end elevational view of the pad of FIG. 1.
Figure 4:
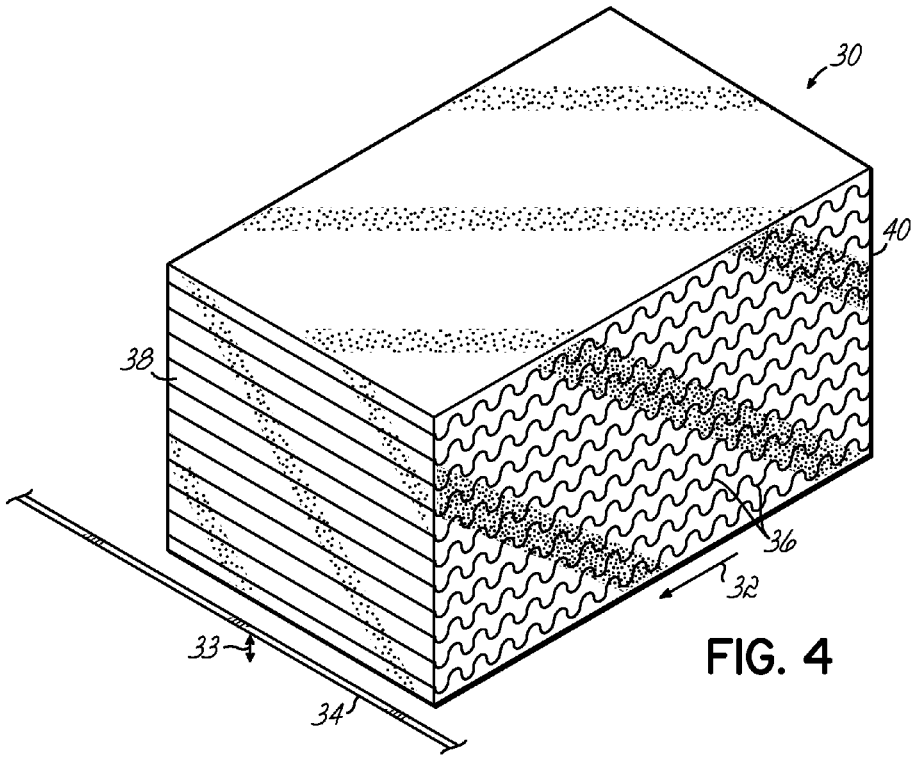
FIGS. 4 and 5 are illustrations of a method of manufacturing the pad of FIG. 1.
Figure 5:
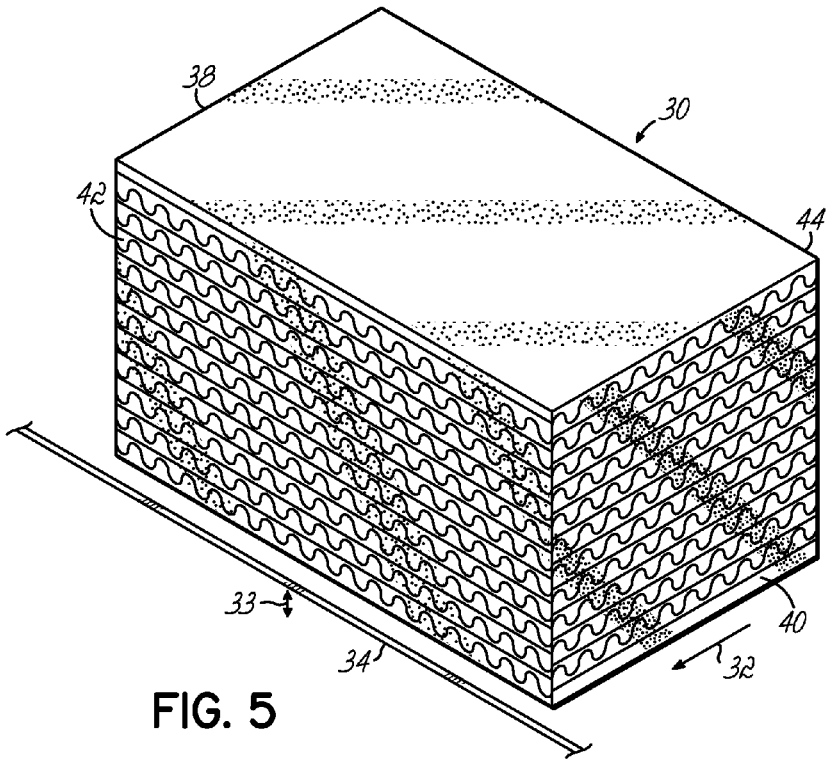

With reference now to FIGS. 4 and 5, and particularly, first with reference to FIG. 4, it will be seen that in order to create the multiple pads configured as the pad of FIG. 1 from a block of foam material 30, the block is moved as indicated by the arrow 32 past a band saw cutting blade 34 while the blade moves up and down for a distance D to create a sinusoidal cut pattern 36 through the block. The band saw blade 34 is a component of a conventional CNC (Computerized Numerical Control) band saw foam cutting machine. This pattern of cuts is repeated as the band saw is spaced upwardly for each successive cut. In the illustrated embodiment, there are 11 such cuts made from the one side 38 of the block 30 to the opposite side 40 with each cut being spaced from the preceding cut by the height of the two pads. As an alternative to making successive cuts through the block from one side 38 to the opposite side 40, multiple band saw blades could be used on such a machine to make simultaneous sinusoidal cuts through the block as the block made a single pass past the blades 34.

After all of the cuts have been made from the one side 38 to the opposite side 40, the block is then rotated 90° to the position illustrated in FIG. 5, after which the block 40 is moved in the same direction 32 past the band saw blade 34 while the blade is reciprocated vertically for a distance equal to the depth D of the valleys in the sinusoidal pattern created as the block 40 moves past the blade 34. The spacing of each successive cut of the blade through the block from the side 42 to the side 44 is the same as the overall height or thickness of two pads to be created by the successive cuts, but the cuts are located midway between the first set of cuts made between the sides 38 and 40. And in making the second set of cuts from the side 42 to the side 44, the valleys 14*a* made during this second set of cuts intersect the valleys 14 which were made in the preceding set of cuts from the side 38 to the side 40. Thereby, the holes 20 are created by the interacting valleys of the two sinusoidal patterns of cuts on the top and bottom surfaces 16, 18 of each resulting pad 10.

It will be appreciated that by manufacturing the pads 10 according to the process described hereinabove and illustrated in FIGS. 4 and 5, the pads are created with ventilation holes and without any wasted material which would otherwise be required to create perforations or holes through the pad. As a result of this cutting technique, though, no material is wasted in creating of the holes or apertures 20.

Figure 6:
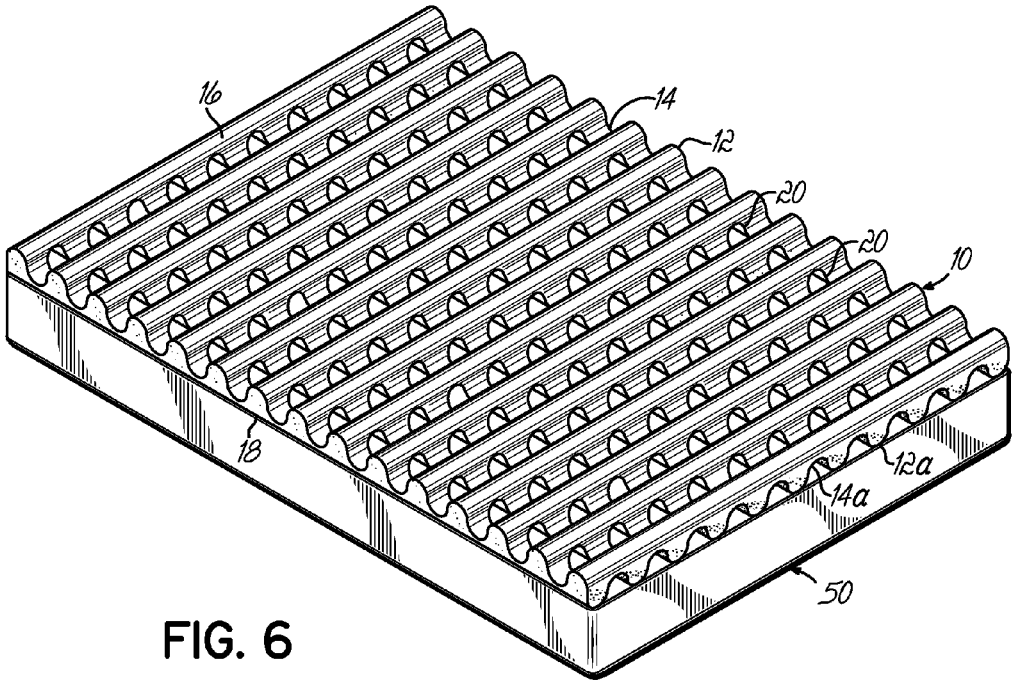
FIG. 6 is a perspective view of the pad of FIG. 1 utilized as a topper pad of a mattress or cushion.

With reference now to FIG. 6, there is illustrated a pad 10 utilized as a topper over a mattress or cushion base 50. When so used, the topper 10 having the ventilation apertures 20 formed therein is sized so as to have the same dimensions longitudinally and transversely as the underlying cushion or mattress 50. The topper may either be subsequently contained within the upholstered covering of the mattress or may be utilized as a separate individual pad atop the upholstered mattress and simply covered by a sheet when used as an underlying comfort element of a bed.

Figure 7:
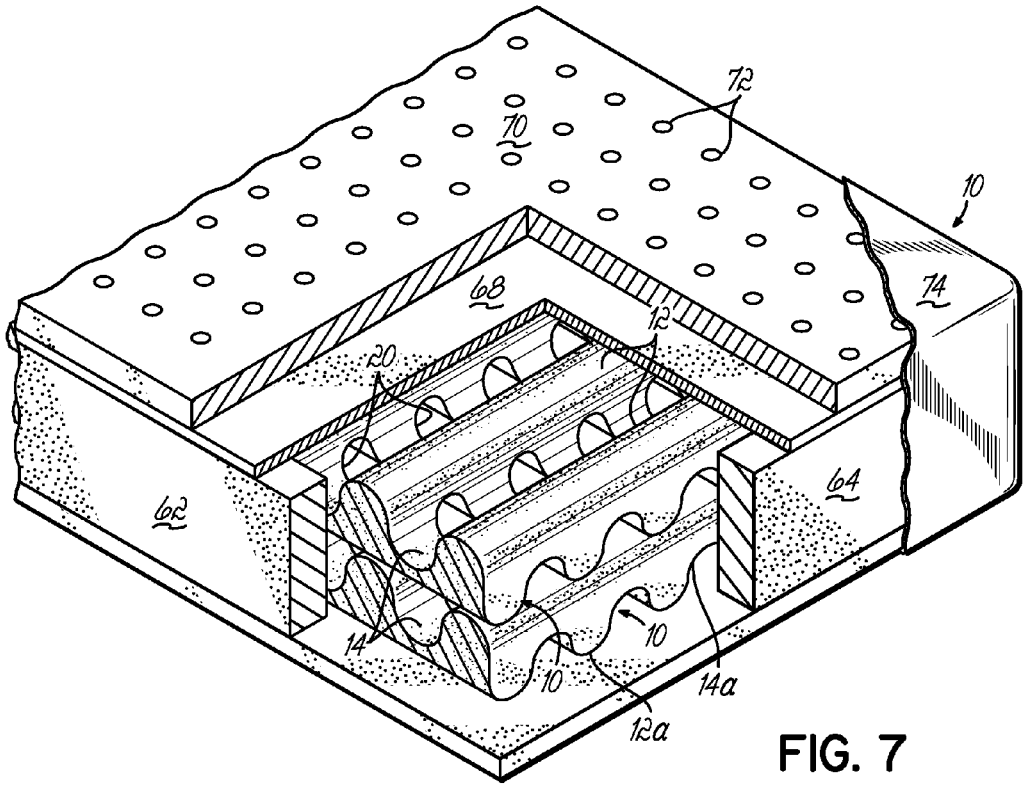
FIG. 7 is a perspective view, partially broken away, of a mattress incorporating multiple pads of this invention as resilient spring core elements of the mattress.

With reference now to FIG. 7, there is illustrated the use of multiple pads 10 as spring core elements of a mattress 60. When so used, multiple pads 10 are stacked one atop the other and then encased on the ends and sides by foam encasement side and end rails 62, 64, respectively. These rails 62, 64 are of the same height as the combined height of the stacked ventilated pads 10. While only two stacked pads are illustrated in the mattress 60, there could be a greater or lesser number of pads used in this manner. To complete the mattress 60 having a core made from multiple pads 10 and surrounding foam encasement side rails 62, 64, there is an underlying base pad 66 sized so as to cover the bottom surface of the pads 10 as well as the bottom edge surface of the encasement side and end rails 62, 64. Additionally, in this illustrated mattress, there is a top layer 68 of open cell foam sized so as to cover the top surface of the pads 10, as well as the top edge surface of the side and end rails 62, 64. This top layer 68 of foam material is preferably made from an open cell foam so as to permit air to pass through this top layer of foam. Additionally, this top layer 68 is in turn covered by a top or ply 70 of foam material which is preferably a visco foam or a latex foam material having perforations 72 therein to again permit breatheability and body heat dissipation through the mattress. The complete mattress is then encapsulated within an upholstered covering 74 either with or without the presence of fiber batting (not shown) between the top surface of the top layer 70 of foam material and the upholstered covering material.

This illustrated mattress 60 is, of course, a single-sided mattress. This invention, though, is equally applicable to double-sided mattresses in which event the bottom side of the mattress would have the same multiple plies of covering materials as the top side.

In one embodiment of the invention, the bottom ply of base foam material 66 was made from a 1.5 pound per cubic foot urethane foam having a 50-70 IFD (a standard measure of load-bearing capacity of a resilient material standing for Indentation Force Deflection). The spring core foam pads 10 were made from 1.5-2.5 pound per cubic foot urethane foam material having a 20-80 IFD. The foam encasement side rails were made from a 1.2-2.5 pound per cubic foot urethane foam having a 50-80 IFD. The top layer 68 of open cell foam material was made from a 1.2-4.0 pound per cubic foot polyester material having a 15-40 IFD. The top layer of visco foam or latex foam material 70 was made from a 1.8-8.0 pound per cubic foot visco foam or latex foam material having an 8-40 IFD. These density and IFD measure of foams are exemplary only and are not intended to be limiting. Similarly, the use of the pads in a mattress having these particular density and IFD characteristics are not intended to be limiting to the use or characteristics of these pads, but are only exemplary of characteristics and applications to which the pads of this invention are applicable.

I claim:

1. A mattress or cushion pad having top and bottom surfaces;

said top surface of said pad being defined at least in part by parallel ridges and valleys having a first shape;

said bottom surface of said pad also being defined at least in part by parallel ridges and valleys having a second shape substantially identical to the first shape, said ridges and valleys of said bottom surface being angled relative to said ridges and valleys of said top surface;

the valleys of said top and bottom surfaces being of sufficient depth that the valleys intersect to create spaced ventilation holes through said pad.

2. The mattress or cushion pad of claim 1 wherein said ridges and valleys of said top surface extend at right angles to the ridges and valleys of said bottom surface.

3. The mattress or cushion pad of claim 1 wherein said pad is made of a foam material.

4. The mattress or cushion pad of claim 1 wherein said pad is made of a polyurethane foam material.

5. The mattress or cushion pad of claim 1 wherein said pad is made of a latex or synthetic latex foam material.

6. The mattress or cushion pad of claim 1 wherein said ridges and valleys of said top surface generally define a sinusoidal-shaped surface.

7. The mattress or cushion pad of claim 1 wherein said ridges and valleys of said bottom surface generally define a sinusoidal-shaped bottom surface.

8. A mattress core comprising at least two substantially identical foam pads resting one atop the other, each of said pads having top and bottom surfaces;

said top surface of each of said pads being defined at least in part by parallel ridges and valleys having a first shape;

said bottom surface of each of said pads also being defined at least in part by parallel ridges and valleys having a second shape substantially identical to the first shape, said ridges and valleys of said bottom surface being angled relative to said ridges and valleys of said top surface;

the valleys of said top and bottom surfaces being of sufficient depth that the valleys intersect to create spaced ventilation holes through said pad.

9. The mattress core of claim 8 wherein said ridge and valleys of said top surface of each of said pads extend at right angles to the ridges and valleys of said bottom surface.

10. The mattress core of claim 8 wherein said pads are encased on all sides by foam material side rails.

11. The mattress core of claim 8 wherein said pads are made of a polyurethane foam material.

12. The mattress core of claim 8 wherein said pads are made of a latex or synthetic latex foam material.

13. The mattress core of claim 8 wherein said ridges and valleys of said top and bottom surfaces of said pads generally define a sinusoidal-shaped surface.

14. A bedding mattress comprising:

a base layer of foam material;

a mattress core resting atop said base layer;

said mattress core comprising at least two substantially identical foam pads resting one atop the other, each of said pads having top and bottom surfaces;

said top surface of each of said pads being defined at least in part by parallel ridges and valleys having a first shape;

said bottom surface of each of said pads also being defined at least in part by parallel ridges and valleys having a second shape substantially identical to the first shape, said ridges and valleys of said bottom surface being angled relative to said ridges and valleys of said top surface;

the valleys of said top and bottom surfaces being of sufficient depth that the valleys intersect to create spaced ventilation holes through said pad;

an intermediate layer of foam material resting atop said mattress core; and a top layer of foam material atop said intermediate layer.

15. The bedding mattress of claim 14 wherein said intermediate layer of foam is made of an open cell foam.

16. The bedding mattress of claim 14 wherein said top layer is made of a visco foam.

17. The bedding mattress of claim 14 wherein said top layer is made of a latex foam.

* * * * *